US005084431A

United States Patent [19]

Pilikos et al.

[11] Patent Number: 5,084,431

[45] Date of Patent: Jan. 28, 1992

[54] PRESSURE-SENSITIVE COPYING PAPER

[75] Inventors: Constantinos Pilikos, Enfield; Antony P. Way, Aylesbury, both of England; Bruno Grimaldi, Rome, Italy; Jacques A. Broyard, Nivelles, Belgium

[73] Assignee: The Wiggins Teape Group Limited, United Kingdom

[21] Appl. No.: 373,452

[22] Filed: Jun. 30, 1989

[30] Foreign Application Priority Data

Jul. 1, 1988 [GB] United Kingdom ..... 8815726
May 24, 1989 [GB] United Kingdom ..... 8911971

[51] Int. Cl.[5] ..... B41M 5/155; B41M 5/165

[52] U.S. Cl. ..... 503/200; 427/150; 503/215; 503/225; 503/226

[58] Field of Search ..... 427/150–152; 428/211, 537.5; 503/200, 215, 226, 225

[56] References Cited

U.S. PATENT DOCUMENTS

| | | | |
|---|---|---|---|
| 4,046,404 | 9/1977 | Treier | 428/327 |
| 4,912,080 | 3/1990 | Weinstein | 503/200 |
| 4,959,343 | 9/1990 | Weinstein | 503/200 |

FOREIGN PATENT DOCUMENTS

| | | | |
|---|---|---|---|
| 0098059 | 1/1984 | European Pat. Off. . | |
| 59-104991 | 6/1984 | Japan . | |
| 59-104992 | 6/1984 | Japan . | |
| 59-106990 | 6/1984 | Japan . | |
| 59-106991 | 6/1984 | Japan . | |
| WO89/00110 | 1/1989 | PCT Int'l Appl. | 503/200 |
| 1042596 | 9/1966 | United Kingdom . | |
| 1042597 | 9/1966 | United Kingdom . | |
| 1042598 | 9/1966 | United Kingdom . | |
| 1042599 | 9/1966 | United Kingdom . | |
| 1051661 | 12/1966 | United Kingdom . | |
| 1585288 | 2/1981 | United Kingdom . | |
| 2066280 | 7/1981 | United Kingdom . | |
| WO88/04614 | 6/1988 | World Int. Prop. O. | 503/200 |

*Primary Examiner*—Pamela R. Schwartz
*Attorney, Agent, or Firm*—Burns, Doane, Swecker & Mathis

[57] ABSTRACT

Pressure-sensitive copying paper of particular suitability for the production of business forms sets by xerographic photocopying processes (including laser printing processes) carries, as loadings within the thickness of the paper:

(a) inorganic color developer material; and
(b) microcapsules containing a substantially colorless chromogenic material;

and is characterized in that it has:

(i) a mean Bendsten roughness on its top side up to 880 $ml.min^{-1}$;
(ii) a mean Bendsten porosity of up to about 200 $ml.min^{-1}$; and
(iii) an ex-mill moisture content of not more than about 5.5%, based on the total weight of the paper.

The use of paper as defined above minimises jamming and other problems commonly encountered when attempting to produce business forms sets from pressure-sensitive copying papers by xerographic photocopying processes.

10 Claims, No Drawings

PRESSURE-SENSITIVE COPYING PAPER

This invention relates to pressure-sensitive copying paper, also known as carbonless copying paper.

Pressure-sensitive copying paper is well-known and is widely used in the production of business forms sets. The precise nature of such sets varies in dependence on the type of pressure-sensitive copying paper used in them.

The most widely used type of pressure-sensitive copying paper is known as the transfer type. A business forms set using the transfer type of pressure-sensitive copying paper comprises an upper sheet coated on its lower surface with microcapsules containing a solution in an oil solvent of at least one chromogenic material (alternatively termed a colour former) and a lower sheet coated on its upper surface with a colour developer composition. If more than one copy is required, one or more intermediate sheets are provided each of which is coated on its lower surface with microcapsules and on its upper surface with colour developer composition. Pressure exerted on the sheets by writing, typing or impact printing (e.g. daisy-wheel printing) ruptures the microcapsules thereby releasing chromogenic material solution on to the colour developer composition and giving rise to a chemical reaction which develops the colour of the chromogenic material and so produces a copy image.

In another type of pressure-sensitive copying paper, known as the self-contained or autogeneous type, both the microcapsules containing the chromogenic material and the colour developer composition are carried by the same sheet. Business forms sets using this type of pressure-sensitive copying paper therefore generally comprise a top sheet of conventional plain paper, e.g. a bond paper, and one or more lower plies on which a copy image is produced on rupture of the microcapsules in response to imaging pressure applied to the top sheet.

Pressure-sensitive copying papers of the self-contained or autogeneous type are themselves of two types, namely the coated type and the loaded type. In the coated type, both the microcapsules and the colour developer material are present as coatings in one or more layers on the surface of the paper. In contrast, in the loaded type, both the microcapsules and the colour developer material are retained as loadings within the thickness of the paper, rather than on its surface. This is achieved by adding the microcapsules and the colour developer material to the papermaking stock(i.e. fibre suspension) before this stock is drained on the papermaking wire to form a paper web. As with mineral and other conventional paper loadings, the microcapsules and colour developer material are retained within the mesh of wet fibres on the papermaking wire as the water drains through the wire. Loaded self-contained pressure-sensitive copying papers and their production are described, for example, in UK Patent Specification No. 1042599. The loaded self-contained pressure-sensitive copying papers described in that patent generally use a di-thio-oxamide/nickel rosinate colour generating system, whereas loaded self-contained papers currently on the market use a different colour generating system, namely one using an electron donating chromogenic material and an acid clay colour developer.

When producing business forms sets from pressure-sensitive copying papers, conventional printing processes such as offset lithography and photogravure have generally been used. In recent years however, the increasing sophistication, durability and reliability of xerographic photocopying and collating equipment has led to such printing processes being replaced for certain tasks by xerographic photocopying of a suitable master. The production of business forms by such a photocopying process would offer advantages in certain situations. However, the potential for production of business forms in this manner is limited by the fact that pressure-sensitive copying papers currently on the market do not generally give good results when used for long print runs in a xerographic photocopier (the term "photocopier" in this context includes not just xerographic photocopies or the kind long used in offices and photocopying agencies, but also more recently developed equipment working on xerographic photocopier principles, such as laser printers).

The most commonly encountered problems are jamming of the paper in the photocopier, contamination of copier belts, the photoreceptor and/or the fuser roll with fibre or other debris from the paper, premature colouration of the paper by reaction of chromogenic material solution from damaged microcapsules with colour developer, so producing a grey or blue background hue, loss of copy-imaging capabiltiy of the paper, and curl (i.e. the paper will not lie flat). The reasons for the occurrence of these problems are not fully understood, but since the problems are most serious when long print runs are attempted, it is thought that the high temperatures reached within the photocopier during a long print run are primarily responsible.

The nature and seriousness of the problems encountered depends to some extent on the type of pressure-sensitive copying paper being used. Coated pressure-sensitive copying papers give rise to more problems than uncoated pressure-sensitive copying papers, particularly when the coatings contain a high proportion of thermally-softenable components, for example phenolic resin colour developers. It is thought that the fact that coated pressure-sensitive copying papers are "two-sided" (i.e. the characteristics of their two surfaces are very different) accounts for some of the problems, for example jamming, and curl. Loaded self-contained papers, which are uncoated and so have opposite surfaces of generally similar characteristics, therefore offer the most potential for production of business forms by xerographic photocopying processes.

However, we have found that whilst loaded self-contained papers can be printed up into business forms using xerographic photocopying processes when very short runs are required, problems of the general kind described above are encountered if longer runs are attempted (by "longer runs" is meant runs in which more than one or two thousand impressions are desired—current market requirements are often for a pressure-sensitive copying paper which will permit at least 20,000 photocopy impressions in a single continuous run).

It is an object of the present invention to provide a loaded self-contained pressure-sensitive copying paper which will meet this market requirement, or at the very least will permit significantly longer xerographic photocopy print runs than are attainable with loaded self-contained pressure-sensitive copying papers currently on the market.

A factor which has to be borne in mind in seeking to achieve this objective is that it should preferably be possible for the various sheets in the set to be glued together by "edge-padding" techniques of the kind widely used in conventional production of "fan-apart" business forms sets. In edge padding to produce fan-apart forms sets, sheets are stacked in the sequence required in the forms sets, and one or more applications of adhesive are made to the edge of the stack. After drying, the adhesive-coated edge of the stack is disturbed by fanning the edges of the stacked sheets, with the result that the stack separates into discrete sets which are not bonded to one another but in which individual sheets are bonded together. Such edge padding techniques are described, for example, in UK Patent Specification No. 1051661.

Edge padding is relatively easy to accomplish with pressure-sensitive copying papers of the transfer type. This is because the bonding characteristics of an adhesive vary according to the surface characteristics of the sheets with which it is in contact. The adhesive can therefore be chosen such that it bonds coated surfaces together strongly, but uncoated surfaces only weakly. Thus when the (dried) adhesive coated edge of the stack is disturbed by fanning the edges of the stacked sheets, bond-breaking occurs when two uncoated surfaces are together so breaking up the stack into sets in which individual sheets are bonded together.

Edge padding has not hitherto been satisfactorily achievable with loaded pressure-sensitive copying papers, so far as we are aware, presumably because the surfaces of all the sheets in the set, including the plain top sheet, are uncoated. Thus the bond formed between adjacent sheets within each set will be of comparable strength to the bond formed between the lowermost sheet of each set and the uppermost sheet of the next lower set. As a result, the sheets in the stack may either bond together so strongly that individual sets do not separate readily on fanning apart, or bond together so weakly that the individual sets do not hold together, depending on the strength of the adhesive used.

When considering the modification of a conventional loaded self-contained paper to improve its suitability for forms production by xerographic photocopying processes, it is desirable that the modified paper should be capable of being matched to an adhesive to provide acceptable edge padding characteristics, as otherwise the utility of the photocopy-printed copying paper will be greatly restricted.

The patent literature contains a number of proposals for adapting pressure-sensitive copying papers so that they may be printed up into forms sets by xerographic photocopying processes.

U.K. Patent Specification No. 1585288 proposes the incorporation in the base paper of hollow lightweight generally spherical particles. Adoption of this proposal would clearly increase paper costs. Whilst brief reference is made to loaded self-contained pressure-sensitive copying papers, most of the disclosure, including all the Examples, is concerned with coated pressure-sensitive copying papers.

European Patent Application No. 98059A proposes the use of a non-reactive pigment top coating over a thermoplastic organic colour developer coating so as to prevent copier contamination when the paper is printed using photocopying techniques.

UK Patent Application No 2066280A proposes the inclusion in microcapsule coatings of finely divided hydrophobic surfaced silica particles.

Japanese Examined Patent Application No. 59-104991 proposes the use of a base paper of which the moisture content does not exceed 6.0%.

Japanese examined Patent Application No. 59-104992 proposes the use of a base paper of which the air permeability exceeds 150 sec.

Japanese examined Patent Application No. 59-106990 proposes the use of a base paper of which the ash content is less than 7%.

Japanese examined Patent Application No. 59-106991 proposes the use of a base paper having a density of less than 0.75.

The detailed disclosure and Examples of all of the above-identified Japanese patent applications are exclusively concerned with coated pressure-sensitive copying papers, although they do in their claims refer to paper coated or impregnated with a colour forming dyestuff (i.e. a chromogenic material), and a colouring material (i.e. a colour developer).

It has now been found that a loaded self-contained pressure-sensitive copying paper having improved suitability for forms production by xerographic photocopying processes, can be attained by lowering the top side roughness and moisture content of the paper, and decreasing the porosity and preferably also the Cobb surface sizing level of the paper, compared with the loaded pressure-sensitive copying papers currently on sale. For the avoidance of doubt, the expression "top side" in this specification means the surface of the paper opposite to the surface of the paper which was in contact with the papermaking wire (the "wire side") during formation of the paper on the papermaking wire. This terminology is of course consistent with that generally used in the paper industry.

Accordingly, the present invention provides, in a first aspect, pressure-sensitive copying paper carrying, as loadings within the thickness of the paper:

(a) inorganic colour developer material; and (b) microcapsules containing a substantially colourless chromogenic material;

the microcapsules being rupturable by imaging pressure to release chromogenic material into contact with the colour developer material, thereby to produce a coloured copy image, and said paper being characterized in that it has:

(i) a mean Bendsten roughness on its top side of up to 880 $ml.min^{-1}$;

(ii) a mean Bendsten porosity in the range of up to 200 $ml.min^{-1}$; and (iii) an ex-mill moisture content of not more than about 5.5%, based on the total weight of the paper.

By way of comparison, a conventional loaded self-contained pressure-sensitive copying paper typically has the following characteristics:

(i) a mean Bendsten roughness on its top side in the range of from 900 to 1000 $ml.min^{-1}$;

(ii) a mean Bendsten porosity of from 300 to 400 $ml.min^{-1}$;

(iii) an ex-mill moisture content of 5.5 to 7.5%, based on the total weight of the paper.

Conventional loaded self-contained pressure-sensitive copying papers are found to show quite substantial variations in paper properties from making to making and web to web, and even at different positions across and along the web. We have found this to be true also of the present loaded self-contained pressure-sensitive copying paper. Thus when sheet samples derived from different parts of a web, or from different webs, are subjected to testing, a considerable scatter in the data obtained is quite normal. A further factor is that certain paper tests are known to give results which individually may exhibit poor reproducibility even when conducted on the same sample. This is especially true of Bendsten roughness results, where the nature of the test, and the fact that it is operator-dependent, are well-known in the art as tending to give variable results. Thus it is important when making comparisons of paper properties between the present paper and the conventional paper to consider populations of data from a number of samples of the papers rather than just individual values. For this reason, mean values within specified ranges have been quoted in defining the invention, and a particular batch of paper for which the great majority of measured mean values falls within the quoted ranges should not be regarded as outside the definition merely because the measured values for a small proportion of the samples fall outside these ranges.

It will be noted that no lower threshold has been specified for the Bendsten top side roughness and Bendsten porosity of the present paper. This is because no lower limit has been identified below which runnability through a xerographic photocopier is necessarily impaired. In practice however, the present self-contained pressure-sensitive copying papers generally have a Bendsten roughness on their top side in the range of about 500 to about 880 ml. $min^{-1}$.

When exposed to ambient conditions, papers gradually acquire a moisture content which is in equilibrium with the ambient relative humidity. Moisture content is known to be a significant factor in the proper functioning of papers for xerographic photocopier use, and hence conventional bond photocopier papers are normally pre-packed in wrappings which exclude ambient moisture and so keep the paper at the moisture content at which the paper left the paper mill (the "ex-mill" moisture content). The present paper will require to be packaged in a similar manner, and so the moisture contents quoted above are in terms of ex-mill values.

The wire side Bendsten roughness of the paper may be somewhat lower than that of a typical conventional loaded self-contained pressure-sensitive copying paper (for example up to 550 ml $min^{-1}$ rather than 560 to 710 ml $min^{-1}$) but this is not essential.

A property of the present paper which is significant in terms of runnability of the paper in long runs through a xerographic photocopier is stiffness. We have found that the present paper should have a Taber stiffness in the range of about 1.50 to about 1.60 (machine direction) and 0.50 to 0.70 or 0.80 (cross direction). These values are much the same as for conventional loaded self-contained pressure-sensitive copying papers, and so in themselves do not differentiate the present paper from the conventional paper.

Two further properties of the present paper which are thought to be important if the present paper is required to be suitable for edge padding are Cobb sizing and contact angle. We have found, rather surprisingly, that although the present paper is best produced using a higher surface sizing level than in conventional loaded self-contained pressure-sensitive copying papers, it has a higher top side Cobb sizing level than these conventional papers. This is of course directly contrary to what would normally be expected to result from an increased surface sizing level. We have also found that the surface sizing level should be higher on one surface of the paper (preferably the top side) than on the other surface (spraying may for example be used to achieve this). Thus whereas Cobb sizing values for the wire side are preferably in the range of about 20 to about 24 g $m^{-2}$ $min^{-1}$, the Cobb sizing values for the top side are preferably in the range 26 to 31 g $m^{-2}$ $min^{-1}$. It is considered that a differential in Cobb sizing values between the two surfaces of about 4 to 7, preferably 6 to 7, g $m^{-2}$ $min^{-1}$ is important in obtaining the desired edge padding characteristics. By contrast, in conventional self-contained pressure-sensitive copying papers, the Cobb values on opposite sides of the paper are similar and typically of the order of 21 to 24 g $m^{-2}$ $min^{-1}$.

The differences in Cobb sizing values between the two surfaces of the paper have so far not been found to be clearly reflected in major differences in contact angle between the two sides. Scatter in the data was found to make comparison difficult. In some cases higher values were obtained for the top side, but these values were not conclusive. Generally, contact angles for both sides of the present paper fall in the range 90° to 115°, with the majority of measured values being in the band 97° to 108° (whether measured after a 2 second contact time or a 30 second contact time). This is slightly lower than for conventional loaded self-contained pressure-sensitive copying papers, for which contact angle values generally fall in the range 110° to 115° (for both sides of the paper, and regardless of whether the contact time is 2 seconds or 30 seconds).

The present invention provides in a second aspect, a process for the production of business forms from pressure-sensitive copying paper by a xerographic photocopying process, wherein the pressure-sensitive copying paper used in the process is a paper according to said first aspect of the invention.

The present invention provides in a third aspect a business forms set comprising a plain paper top sheet and one or more xerographic photocopy-printed lower sheets, wherein the or each lower sheet is derived from pressure-sensitive copying paper according to said first aspect of the invention. It will be appreciated that passage through the copier may alter certain of the paper properties, for example roughness, and that, as state above, the moisture content of the imaged paper is likely to alter as equilibration with ambient humidity occurs. Measurements on a photocopy-printed sheet should not therefore be expected to correspond to those on the same sheet prior to photocopy imaging. The definitions herein are therefore based on the paper before photocopy imaging.

The grammage of the present paper appears not to be critical, although if it is too low, it may not be possible to achieve the previously specified properties, particularly stiffness, and the printed paper may exhibit more curl, i.e. it may not lie flat. A grammage of the order of 60 g $m^{-2}$ (including the microcapsule and colour developer loadings) has so far been found to give optimum properties, bearing in mind that as the grammage increases, the pressure-transmission characteristics of the paper are lessened, with the result that the maximum number of legible copies obtainable in a forms set is reduced. This grammage also gives rise to a sheet thickness comparable to that of plain bond papers normally used in xerographic photocopiers, and thus the sheet is well suited to feeding along the paper path of the copier.

In order to achieve the desired reduction in Bendsten roughness and improved paper formation, it is desirable to use a dandy roll on the paper machine on which the paper is produced (a dandy roll has not hitherto been used in the production of loaded self-contained pressure-sensitive copying papers, so far as we are aware).

As stated previously, the present paper relies in part for its effectiveness on the use of higher surface sizing levels than are used in conventional loaded self-contained pressure-sensitive copying papers. In these conventional papers, surface sizing is by means of a combination of a starch surface size and a synthetic surface size at levels of about 3.3% and 1.3% respectively, based in each case on the total weight of the paper. In the present paper, a surface sizing starch level of the order of 5 to 7% and a synthetic surface sizing agent level of the order of 2% are preferred, based in each case on the total weight of the paper.

The precise role of the surface size in achieving the desired paper characteristics is not fully understood, particularly since, as previously mentioned, the present paper with these higher sizing levels has higher rather than lower Cobb levels than the conventional paper. It is thought that the sizing composition may form a barrier which retains within the paper debris which would otherwise break away and cause copier contamination.

The inorganic colour developing material used in the present copying paper is preferably an acid clay, for example an acid-washed montmorillonite clay, such as that disclosed in UK Patent No. 1213835. Alternatively, hydrated silica/hydrated alumina composites as disclosed in European Patent Applications Nos. 422165A and 42266A, hydrated zirconia or composites thereof as disclosed in UK Patent Application No. 2112159A or European Patent Application No. 81341A, or semi-synthetic inorganic colour developer materials such as disclosed in European Patent Application No. 44645A may be used.

The chromogenic material used in the present copying paper may be a blend of colour formers as conventionally used in pressure-sensitive copying papers. Such colour formers are very widely disclosed in the patent literature and so will not be discussed extensively herein. By way of example, the electron-donating colour formers may be phthalide derivatives, such as 3,3-bis(4-dimethylaminophenyl)-6-dimethylaminophthalide (CVL) and 3,3-bis(1-octyl-2-methylindol-3-yl)phthalide, or fluoran derivatives, such as 2'-anilino-6'-diethylamino-3'-methylfluoran, 6'-dimethylamino-2'-(N-ethyl-N-phenylamino-4'-methylfluoran), and 3'-chloro-6'-cyclohexylaminofluoran.

The solvents used to dissolve the chromogenic material may also be as conventionally used in pressure-sensitive copying papers. These materials are also widely disclosed in the patent literature. Examples of suitable solvents are partially hydrogenated terphenyls, alkyl naphthalenes, diarylmethane derivatives, dibenzyl benzene derivatives, alkyl benzenes and biphenyl derivatives, optionally mixed with diluents or extenders such as kerosene.

The chromogenic material solution may be encapsulated by encapsulation processes conventional in the art, particularly processes which give rise to microcapsules having walls of synthetic polymer material, for example aminoplast material. Examples of such processes are those disclosed in U.S. Pat. Nos. 3,516,846; 3,516,941; 4,001,140; and 4,105,823.

The invention will now be illustrated by the following Example, in which all percentages are by weight and are based on the total weight of the paper:

EXAMPLE 1

Run 1

A loaded self-contained pressure-sensitive copying paper of nominal grammage 60 g $m^{-2}$ (including loadings) was produced on a Fourdrinier paper machine. The microcapsules used had been produced by a process as described in U.K. Patent No. 1,507,739, and contained a conventional black-copy electron donating colour former formulation in a conventional partially hydrogenated terphenyl/alkyl benzene mixed solvent composition. The microcapsules were present in an amount of about 8%. The colour developer material was an acid-washed dioctahedral montmorillonite clay supplied as "Copisil D4A10" by Süd-Chemie A. G. of Munich, Federal Republic of Germany and was present in an amount of about 6%. The paper contained a conventional proprietary synthetic surface sizing agent ("Cartocoll A" supplied by Sandoz A. G. of Basle, Switzerland) at a level of about 2.0% and a gelatinized starch surface size was applied by means of a size press to give a starch content of 6.6%. The paper was dried to a moisture content of about 4.8%. A dandy roll was employed on the papermaking wire.

Run 2

The procedure of Run 1 was repeated, except that the moisture content was 4.5% and that the drying conditions were such as to induce a slight curling tendency on the wire side of the paper. This was intended to compensate for the tendency of a photocopier to produce an opposite curling tendency during the passage of the paper through the copier.

Run 3

The procedure of Run 2 was repeated, except that the moisture content was 5.0%.

The resulting paper properties, based on the mean of a number of measurements in each case, were as follows:

| | Run 1* | | | | | |
|---|---|---|---|---|---|---|
| Property | Test 1 | Test 2 | Test 3 | Test 4 | Run 2 | Run 3 |
| Bendsten (TS) | 730 | 510 | 670 | 522 | 650 | 750 |
| Roughness (WS) | 522 | 410 | 458 | 495 | 550 | 564 |
| Porosity | 93 | 125 | — | 93 | 168 | 120 |
| Taber (MD) | 1.52 | — | — | 1.56 | 1.52 | 1.48 |
| Stiffness (CD) | 0.53 | — | — | 0.70 | 0.54 | 0.53 |
| Cobb Sizing (TS) | 29 | 27 | — | 29 | 31 | 38 |
| Degree (WS) | 23 | 22 | — | 22 | 24 | 30 |
| Contact Angle* (TS) | 98 | 113 | — | 98 | 106 | 100 |
| (30 sec) (WS) | 100 | 109 | — | 97 | 105 | 99 |

Key:
TS Top side
WS Wire side
MD Machine direction
CD Cross direction
*Measurements on this paper were done in two different laboratories, and in the case of one laboratory, on three different occasions over an eleven week period. The results amply demonstrate the problems of scatter of data discussed earlier.

Sheets cut from the papers resulting from Runs 1 and 2 were each tested for photocopier printability using a Rank Xerox 9400 xerographic copier. The tests were done in two different ways. In the first of these, the test paper alone was fed through the photocopier, whereas in the second, pre-collated complete (but not glued-together) forms sets of bond paper plus two sheets of the test paper were fed through the photocopier. As a control, copies were also made on good quality speciality plain 80 g $m^{-2}$ photocopier paper (i.e. bond paper). 20,000 impressions were made in each case, after which the copier was examined for contamination and the paper was examined for premature colouration, imaging performance and curl. It was found that there was no more contamination of the copier belts, fuser roll and photoreceptor with the test papers than occurred with the control paper. The runnability of the paper through the copier was also comparable to that of the control paper. Curl of the test paper was somewhat greater than that of the control paper, but was acceptable. It was also found that the test paper retained its original shade well, i.e. there was no significant premature colouration, and that it also retained its copy imaging capability. The same programme was also attempted with the paper from Run 3, but in this case problems were encountered in achieving a long photocopy run. This may possibly be due to the fact that the wire side Bendsten roughness was rather high, and the Taber stiffness rather low compared with the values which we have specified in defining the invention. Nevertheless, the Run 3 paper gave fewer problems than we have typically encountered when trying to run conventional loaded self-contained pressure-sensitive copying papers through a photocopier.

The test paper was also found to be satisfactorily edge-paddable into copying sets with a bond top sheet. The edge padding adhesive used was supplied by Howarine Europe S. A. of Gonesse, France, and had been specially formulated for use with the test paper.

By way of comparison, when extended copy runs were attempted with a conventional 60 g $m^{-2}$ loaded self-contained pressure-sensitive copying paper, there was a gradual build up of problems and the maximum number of satisfactory copies obtained was always in the range of 800 to 2000 copies. These copies were not capable of being edge padded by any currently-available edge-padding adhesive, whether specially developed or otherwise.

EXAMPLE 2

The procedure described in Run 2 of Example 1 was followed, except that the paper was dried to a moisture content of within the range 4.0 to 4.3% by weight, based on the total weight of the paper, and that a different conventional solvent composition was used (a partially hydrogenated terphenyl/kerosene mixture). After sheeting and packaging of the paper, the ex-mill moisture content was found to be 4.4 to 4.5% by weight, based on the total weight of the paper. Samples were taken at three positions across the width of the resulting paper web, and the paper properties, expressed as mean values in each case, were as follows:

| Property | Position 1 | Position 2 | Position 3 |
|---|---|---|---|
| Bendsten (TS) | 878 | 817 | 824 |
| Roughness (WS) | 823 | 678 | 698 |
| Porosity | 146 | 164 | 176 |
| Taber (MD) | 1.52 | 1.49 | 1.52 |
| Stiffness (CD) | 0.61 | 0.76 | 0.73 |
| Cobb Sizing (TS) | 29 | 28 | 29 |
| Degree (WS) | 23 | 22 | 22 |
| Contact | 100 | 101 | 105 |

-continued

| Property | Position 1 | Position 2 | Position 3 |
|---|---|---|---|
| Angle° (TS) (30 sec) (WS) | 108 | 103 | 104 |

Key:
TS Top side
WS Wire side
MD Machine direction
CD Cross direction

The paper was then tested for photocopier printability as described in the first test of Example 1, except that 6000 impressions were made when the test paper alone was fed through the photocopier. In addition 200 pre-collated sets (bond paper plus two sheets of test self-copying paper) were fed through the photocopier. In both cases, the paper ran well with no feeding jams.

We claim:

1. Pressure-sensitive copying paper carrying, as loadings within the thickness of the paper:

(a) inorganic colour developer material; and (b) microcapsules containing a substantially colourless chromogenic material;

the microcapsules being rupturable by imaging pressure to release chromogenic material into contact with the colour developer material, thereby to produce a coloured copy image, and said paper thus being self-contained and characterized in that it has:

(i) a mean Bendsten roughness on its top side of up to 880 ml.$min^{-1}$;

(ii) a mean Bendsten porosity in the range of up to 200 ml.$min^{-1}$; and (iii) an ex-mill moisture content of not more than 5.5%, based on the total weight of the paper.

2. Pressure-sensitive copying paper as claimed in claim 1, wherein the paper has a Taber stiffness in the range 1.50 to 1.60 in the machine direction and 0.50 to 0.80 in the cross-direction.

3. Pressure-sensitive copying paper as claimed in claim 1, wherein there is a differential in Cobb sizing values between two surfaces of the paper of 4 to 7 g $m^{-2}$ $min^{-1}$.

4. Pressure-sensitive copying paper as claimed in claim 3, wherein the differential is 6 to 7 g $m^{-2}$ $min^{-1}$.

5. Pressure-sensitive copying paper as claimed in claim 4 wherein one of the two surfaces is the wire side and the other of the two surfaces is the top side, and wherein the Cobb sizing values of the paper are in the range 20 to 24 g $m^{-2}$ $min^{-1}$ on the wire side and 26 to 31 g $m^{-2}$ $min^{-1}$ on the top side.

6. Pressure-sensitive copying paper as claimed in claim 1 wherein a contact angle (30 second contact time) for both surfaces of the paper is in the range 90° to 115°.

7. Pressure-sensitive copying paper as claimed in claim 6 wherein the contact angle (30 second contact time) for both surfaces of the paper is in the range 97° to 108°.

8. Pressure-sensitive copying paper as claimed in claim 1 wherein the paper has a top side and a wire side, and wherein the top side has a Bendsten roughness up to 800 ml $min^{-1}$ and the wire side has a Bendsten roughness up to 550 ml $min^{-1}$.

9. A process for the production of business forms from pressure-sensitive copying paper by a laser printing or other xerographic photocopying process, wherein the copying paper is a pressure-sensitive copying paper carrying, as loadings within the thickness of the paper:

(a) inorganic colour developer material; and (b) microcapsules containing a substantially colourless chromogenic material;

the microcapsules being rupturable by imaging pressure to release chromogenic material into contact with the colour developer material, thereby to produce a coloured copy image, and said paper thus being self-contained and characterized in that it has:

(i) a mean Bendsten roughness on its top side of up to 880 $ml.min^{-1}$;

(ii) a mean Bendsten porosity in the range of up to 200 $ml.min^{-1}$; and (iii) an ex-mill moisture content of not more than 5.5%, based on the total weight of the paper.

10. A business forms set comprising a plain paper top sheet and one or more laser printed or other xerographic photocopy-printed lower sheets, wherein at least one lower sheet is derived from a pressure sensitive copying paper carrying, as loadings within the thickness of the paper:

(a) inorganic colour developer material; and (b) microcapsules containing a substantially colourless chromogenic material;

the microcapsules being rupturable by imaging pressure to release chromogenic material into contact with the colour developer material, thereby to produce a coloured copy image, and said paper thus being self-contained and characterized in that it has:

(i) a mean Bendsten roughness on its top side of up to 880 $ml.min^{-1}$;

(ii) a mean Bendsten porosity in the range of up to 200 $ml.min^{-1}$; and (iii) an ex-mill moisture content of not more than 5.5%, based on the total weight of the paper.

* * * * *